United States Patent [19]

Wheeler et al.

[11] 4,104,603

[45] Aug. 1, 1978

[54] TACTILE FEEL DEVICE

[75] Inventors: Jay A. Wheeler, Minneapolis; Henry L. Miszkiewicz, Minnetonka; Ronald O. J. Lindberg, Hopkins; James A. Willmore, Eden Prairie, all of Minn.

[73] Assignee: HEI, Inc., Chaska, Minn.

[21] Appl. No.: 769,051

[22] Filed: Feb. 16, 1977

[51] Int. Cl.[2] ..... H01F 7/04; H01H 5/02

[52] U.S. Cl. ..... 335/306; 335/207

[58] Field of Search ..... 335/306, 207, 188, 303, 335/209; 200/67 F

[56] References Cited

U.S. PATENT DOCUMENTS

| | | | |
|---|---|---|---|
| 3,644,855 | 2/1972 | Cherry et al. | 200/67 F |
| 3,815,066 | 6/1974 | Vinal | 335/306 |
| 3,942,145 | 3/1976 | Sobczak | 335/188 |

*Primary Examiner*—Harold Broome

*Attorney, Agent, or Firm*—Dorsey, Windhorst, Hannaford, Whitney & Halladay

[57] ABSTRACT

A tactile feel device which provides a characteristic resistance to movement, and breakaway feel to signal the operator that movement and accompanying function, such as switching, has been accomplished. Resistance to movement is provided by spring biasing means for the initial stroke of the device, by spring biasing means plus magnetic force at the end of the initial stroke, and by spring biasing means only, after magnetic breakaway at the end of the initial stroke, to provide a characteristic breakaway feel. The device is shown and described in connection with a light pen which generates a signal when pressed against a cathode-ray-tube faceplate. The characteristic breakaway feel signals the operator that the tip or probe of the pen has been sufficiently pressed against the cathode-ray-tube to generate the appropriate signal in the light pen.

8 Claims, 5 Drawing Figures

$d_m + d_2$
D
$d_1$

TACTILE FEEL DEVICE

BACKGROUND OF THE INVENTION

The invention pertains to the field of switching by operator discretion and touch, such as by pressing a key on an electric typewriter or other office machine. In an office machine, such as an electric typewriter, where there is no mechanical linkage between the key and the ultimate event sought by pressing the key (the striking of the raised print-face against the typewriter ribbon and paper), there is no feel in the key movement that signals the completion of the event. The operator must resort to sound or to visual inspection to be sure that the desired result has been achieved. The lack of tactile feel tends to cause excessive pressure applied to the key, decreases speed of operation and decreases the psychological fulfillment of the operator. Consequently, there is a need to provide artificial tactile feel so the operator knows immediately by feel, rather than by resort to sound and/or visual inspection, that there has been sufficient key movement to achieve or complete the desired event.

In prior art devices the requisite breakaway tactile feel has been provided by means of over-center action and by separation of a magnetic interface. The Sobczak (U.S. Pat. No. 3,942,145), Walker (U.S. Pat. No. 3,879,602), Kikuchi et al. (U.S. Pat. No. 3,690,432) and Cherry et al. (U.S. Pat. No. 3,644,855) patents are examples of the utilization of magnetic separation to achieve tactile breakaway feel. In these prior art devices there is a steady, constant increase in spring biased resistance to key movement leading to breakaway as the magnetic interface is broken or separated by the spring force, or spring biased resistance is introduced at magnetic separation, which tends to mask the breakaway either prior to or immediately after its occurrence. The Sobczak (U.S. Pat. No. 3,942,145), Walker (U.S. Pat. No. 3,879,602) and Kikuchi et al. (U.S. Pat. No. 3,690,432) patents are examples of masking of the magnetic breakaway prior to its occurrence. This is exemplified by the Load-Time curve of FIG. 9 of the Kikuchi et al. patent, and is characteristic of those devices in which the magnetic interface is broken by kinetic energy stored in a spring (as in Sobczak, Walker and Kikuchi), as distinguished from direct operator force. The Cherry et al. (U.S. Pat. No. 3,644,855) patent is an example of masking of the breakaway immediately after its occurrence. The magnetic interface is broken by direct operator force in Cherry et al., but the magnetic breakaway is masked by the spring resistance introduced at breakaway. These prior art devices do not highlight the breakaway by both a sharp increase in resistance prior to breakaway and a sharp decrease subsequent to breakaway.

The present invention provides a sharp feel both prior and subsequent to the separation of the magnetic interface. In addition, the structure of the present invention provides reliable positive action capable of being repeated without malfunction throughout the life of the apparatus with which it is utilized.

SUMMARY OF THE INVENTION

The present invention is a tactile feel device which utilizes compressive movement resisted by biasing means and magnetic force, to achieve suitable resistance to movement and breakaway feel. An actuator member is coaxially and reciprocally disposed relative to a fixed member. Reciprocal movement of the actuator member with respect to the fixed member defines the overall stroke of the device. A magnet is mounted either to the fixed member or to the actuator member, and a magnetically attractable member is mounted to the other member. Means is provided biasing the actuator member and the fixed member apart to cause the magnet to engage the magnetically attractable element. The magnet and magnetically attractable element are mounted to permit limited axial sliding movement of the magnet with the magnetically attractable element engaged therewith, relative to the actuator member or the fixed member. This limited axial sliding movement defines the initial stroke of the device. Means is provided for limiting the length of the initial stroke to a distance less than the length of the overall stroke. This results in axial compressive movement being resisted only by biasing means through the distance of the initial stroke, and by the biasing means plus the magnetic force at the end of the initial stroke. The magnetically attractable element and magnet are separated as a result of additional force on the actuator member at the end of the secondary stroke, and for the balance of the overall stroke actuator movement is resisted only by the force of the biasing means and, to some extent immediately after breakaway, by the magnetic force while the magnetically attractable element is in the magnetic field of the magnet.

In the embodiment shown, the magnet is mounted to the fixed member and the magnetically attractable element is mounted to the actuator member. The magnetically attractable element is loosely mounted on a pin extending transversely to the axis of the device and, consequently, is axially slidable with respect to the actuator member. The difference between the inside diameter of the tubular member and the outside diameter of the pin defines the distance the magnetically attractable element is slidable with respect to the actuator member, which constitutes the initial stroke. This distance is less than the distance of the overall stroke. A tubular or barrel-type housing member is mounted to and extends coaxially from the fixed member, and the actuator member is reciprocally disposed in the housing with the tip thereof emerging at the end of the housing opposite the fixed member.

DESCRIPTION OF PREFERRED EMBODIMENT

The preferred embodiment of the tactile feel device which constitutes the present invention is shown in a light pen apparatus of the type described in detail in U.S. Pat. No. 3,758,782, entitled Light Pen Apparatus, issued Sept. 11, 1973.

A light pen apparatus responds to light pulses on a cathode-ray-tube screen and generates logic pulses whenever a light pulse is detected. Light from the cathode-ray-tube is directed to a photo diode light sensor operated in the reverse bias mode. The biasing network is such that the alternating current signal is equal and opposite on the anode and cathode of the diode. An optical switch is actuated when the tip of the light pen has been pressed sufficiently hard against the surface of the cathode-ray-tube. The appropriate logic signal is transmitted, depending upon the presence or absence of a light pulse from the cathode-ray-tube at the point of contact between the tip and the tube. The tactile feel device of the present invention may be advantageously used to indicate when the light pen tip has been pressed sufficiently hard against the surface of the cathode-ray-tube to actuate the optical switch.

Figures 1, 3A, 3B:
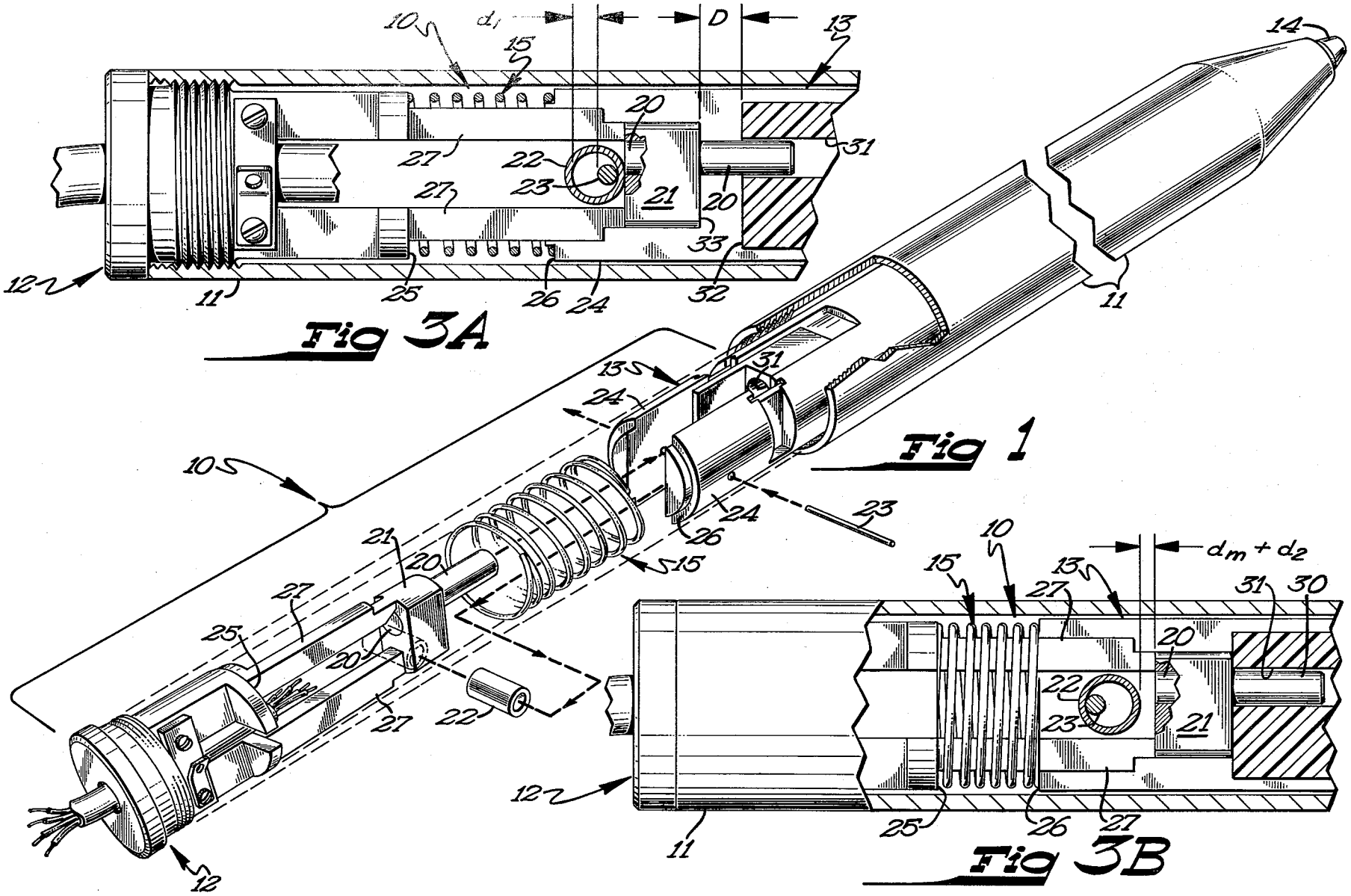
FIG. 1 is an exploded perspective view of a light pen in which the tactile feel device of the present invention is embodied.
FIG. 3A is a longitudinal sectional view of the tactile feel device taken on the line 3—3 of FIG. 2, with the device shown in the normal, quiescent extended position.
FIG. 3B is a longitudinal sectional view of the tactile feel device taken on line 3—3 of FIG. 2, with the device shown in the compressed or retracted position after release or breakaway.
Figure 2:
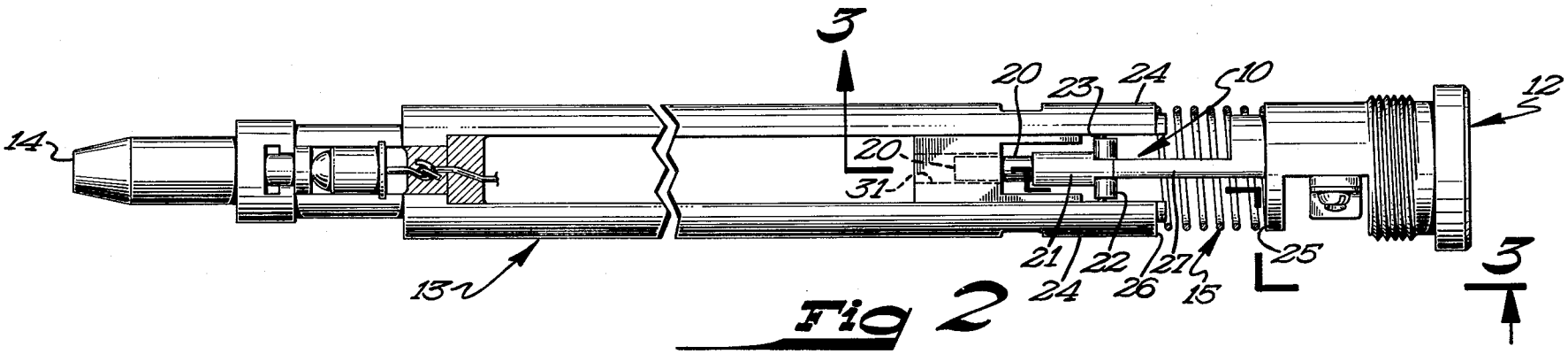
FIG. 2 is a side view of the light pen of FIG. 1 with the tubular housing removed to show the tactile feel device.

The basic elements of the light pen and the tactile feel device are shown in FIGS. 1 and 2. With reference to FIG. 1, the tactile feel device 10 is located and housed in one end of the apparatus in tubular housing 11. End cap or fixed member 12 is threaded into housing 11 and serves as a fixed member, fixed with respect to housing 11. The apparatus includes an actuator member 13 which extends substantially the length of housing 11, is reciprocally or slidably housed therein, and emerges from housing 11 at tip 14. Biasing means consisting of coil spring 15 urges actuator member 13 coaxially away from fixed member 12. The distance that actuator member 13 is reciprocable or slidable in housing 11 is shown at D in FIG. 3A, and constitutes the overall stroke of the light pen apparatus.

The optical switch of the light pen apparatus is actuated when the light pen is grasped by tubular housing 11, and tip 14 is pressed against the face of the cathode-ray-tube causing actuator member 13 to move coaxially toward fixed member 12 against the force of spring 15. Absent tactile feel device 10 of the present invention, the operator would receive no tactile signal, other than that resulting from contact between actuator member 13 and fixed member 12 as shown in FIG. 3B, from which to conclude that tip 14 had been pressed sufficiently hard against the face of the cathode-ray-tube to actuate the optical switch. Reliance upon the tactile feel derived from the "bottoming-out" of actuator member 13 against the shoulder of fixed member 12 as shown in FIG. 3B, is not satisfactory because it occurs after switching has been accomplished and results in the application of excess pressure to tip 14 and the cathode-ray-tube to be sure the apparatus has "bottomed-out".

The tactile feel device 10 is shown in FIGS. 1, 2, 3A and 3B. It includes magnet 20 mounted in the block portion 21 of fixed member 12, and magnetically attractable tubular element 22 loosely mounted on pin 23. Pin 23 is press fit in the finger portions 24 of actuator member 13 and extends transversely to the axis of actuator member 13 as shown. Thus pin 23 is fixed with respect to actuator member 13 and tubular magnetically attractable element 22 is slidable with respect to actuator member 13 a distance equal to the difference in the inside diameter of tubular element 22 and the outside diameter of pin 23, the distance, $d_1$, as shown in FIG. 3A. This distance defines the initial stroke of the apparatus and represents the distance actuator member 13 may be moved with respect to fixed member 12 without unseating magnetically attractable tubular element 22 from magnet 20.

Shoulder 25 is provided on fixed member 12 and shoulder 26 is provided on finger portions 24 of actuator member 13 for seating coil spring 15. Arms 27 of fixed member 12 define an axial slot in which tubular magnetically attractable element 22 is slidable. The expanded length of coil spring 15, the distance from shoulder 25 to the end of fixed member 12 at block portion 21 and the distance between shoulder 26 of actuator member 13 and pin 23 are chosen so that the compression of coil spring 15 causes pin 23 to force magnetically attractable element 22 to engage magnet 20, as shown in FIG. 3A. This is the normal or quiescent position of the tactile feel device.

Magnet 20 is axially mounted in block portion 21 of fixed member 12 and slidably extends into bore 31 of actuator member 13.

The distance, D, the overall stroke of tactile feel device 10, is shown in FIG. 3A. The extended limit is defined by the "bottoming-out" of magnetically attractable element 22 against magnet 20 under the influence of the force of spring 15 acting on magnetically attractable element 22 through pin 23 as shown in FIG. 3A. The compressed limit is defined by the "bottoming-out" of shoulder 32 of finger portions 24 of actuator member 13 against the surface 33 of block portion 21 of fixed member 12 as shown in FIG. 3B.

The distance, $d_1$, (See FIGS. 1 and 4) the initial stroke of tactile feel device 10, is the distance magnetically attractable member 22 is slidable with respect to actuator member 13, or the distance actuator member 13 can move without unseating element 22 from magnet 20. The inside diameter of tubular magnetically attractable element 22 and the outside diameter of pin 23 are chosen so that the distance, $d_1$, or the initial stroke, is appreciable, but less than the distance, D, or the overall stroke.

The light pen apparatus is designed so that the optical switch is actuated just prior to or at breakaway of the tactile feel device so that the tactile feel imparted to the operator is a true signal that the desired event has been achieved.

The operation of the tactile feel device of the present invention is as follows. The normal, quiescent extended position of tactile feel device 10 is shown in FIG. 3A. The fully compressed or retracted position is shown in FIG. 3B, although with the aid of the present invention the fully compressed or retracted position of FIG. 3B need not be reached. The desired event is accomplished and the tactile signal is given to the operator when tactile feel device 10 is between the normal, quiescent extended position of FIG. 3A and the fully compressed or retracted position of FIG. 3B.

With tactile feel device 10 in the normal, quiescent state shown in FIG. 3A, the operator grasps the light pen apparatus by housing 11 and touches tip 14 to the cathode-ray-tube at the selected location on the screen. The housing 11 is then pressed toward the screen. This causes housing 11 and fixed member 12 to move relative to the screen and relative to actuator member 13 against the compressive force of spring 15. Actuator member 13 and pin 23, fixed to arm portion 24 of actuator member 13, slide axially relative to fixed member 12 (although remaining fixed with respect to the cathode-ray-tube) and relative to magnetically attractable element 22 magnetically engaged with magnet 20 without disturbing the engagement of magnetically attractable element 22 with magnet 20 until pin 23 moves from the position shown in FIG. 3A to engage the opposite inside diameter of tubular magnetically attractable element 22. This distance is the initial stroke of the device and is designated, $d_1$, in FIG. 3A. Throughout this initial stroke the movement of actuator member 13 has been resisted only by the force of spring 15 and this resistance is the only thing felt by the operator.

After pin 23 has moved the distance, $d_1$, of FIG. 3A, additional movement of actuator member 13 and pin 23 with respect to fixed member 12 is resisted by the combined force of spring 15 and the force of the magnetic attraction between magnet 20 and tubular magnetically attractable element 22. This is a marked increase in resistance felt by the operator.

Increased operator force on housing 11, necessary to overcome the combined force of spring 15 and the magnetic attraction between magnet 20 and magnetically attractable element 22, is applied to separate or breakaway tubular magnetically attractable element 22 from magnet 20 as shown in FIG. 3B. After breakaway the resistance to axially sliding movement of actuator member 13 with respect to housing 11 and fixed member 12 drops sharply because, with the insignificant exception of magnetic force exerted on element 22 after breakaway while element 22 remains in the magnetic field of magnet 20, the movement is resisted once again only by the force of spring 15.

The light pen apparatus is programmed so that the optical switch is actuated just prior to or at breakaway so that the tactile feel imparted to the operator is a true signal that the desired event has occurred and that the operator may proceed to the next use of or operation with the apparatus. Tip 14 is then lifted from engagement with the screen of the cathode-ray-tube and the force of spring 15 slides actuator member 13 away from fixed member 12 and pin 23 slides magnetically attractable element 22 back into engagement with magnet 20 as shown in FIG. 3A. Tactile feel device 10 is thus returned to its normal, quiescent extended position and is ready for another use or operation.

Figure 4:
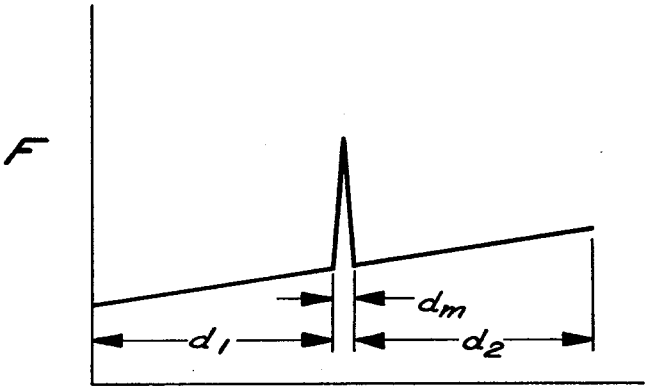
FIG. 4 is a curve which shows the relationship between force, F, and displacement or distance, D, as the tactile feel device is moved from the normal, quiescent extended position of FIG. 3A to the compressed or retracted position of FIG. 3B.

The sharp nature of the tactile feel imparted to the operator by the present invention is illustrated in FIG. 4. The overall stroke, D, of the tactile feel device is:

$$D = d_1 + d_m + d_2$$

where:

$d_1$ = distance of the initial stroke prior to breakaway, $d_m$ = the distance of the influence of the magnetic field, and $d_2$ = the balance of the distance the actuator member can be moved after breakaway, and is shown along the horizontal axis of FIG. 4. The force, F, required to move actuator member 13 relative to fixed member 12 is shown along the vertical axis in FIG. 4 increasing upwardly.

During the initial stroke, $d_1$, of actuator member 13 there is a relatively low resistance to movement, due to the force of spring 15 only, represented by the portion of the curve extending to the right from the vertical axis. When pin 23 contacts the inside diameter of tubular magnetically attractable element 22, the resistance to further movement increases sharply, as shown by the sharp increase in the slope of the curve, due to the influence of the magnetic force. This sharp increase is felt by the operator, and additional force causes separation or breakaway of element 22 from magnet 20, and the resistance to movement drops sharply. This breakaway is represented by the peak and sharp drop in the curve in FIG. 4, also felt by the operator. Further movement of tubular member 22 is resisted once again substantially only by the force of spring 15 as shown by the balance of the curve along the distance, $d_2$.

Thus the present invention provides a readily discernable tactile signal, illustrated in FIG. 4, characterized by a sharp increase in resistance prior to breakaway and a sharp decrease subsequent to breakaway, thus giving a clear breakaway signal to the operator.

The tactile feel device of the present invention has been shown and described in association with a light pen apparatus but it is also suitable for use in other environments in which an artificial tactile signal is desirable. It may be used, for example, in a keyboard for an office machine such as an electric typewriter as well as in numerous other environments which call for switch actuation by operator touch.

Those skilled in the art will also recognize that the relationship between the fixed member 12 and magnet 20, on the one hand, and actuator member 13, pin 23 and tubular magnetically attractable element 22, on the other hand, may be reversed, importance lying only in the relative movement of the elements. Those skilled in the art may devise methods of axially slidably mounting magnet 20 or magnetically attractable element 22 with respect to fixed member 12 or actuator member 13 other than the pin and tube arrangement exemplified by pin 23 and tubular magnetically attractable element 22.

Other variations in the arrangement of parts shown and described in connection with tactile feel device 10 may also be made by those skilled in the art without departing from the spirit and scope of the invention which is defined by the appended claims.

We claim:

1. In a tactile feel device utilizing axial compressive movement resisted by biasing means and magnetic force to achieve suitable resistance to movement and breakaway feel, and having an actuator member coaxially and reciprocally disposed with respect to a fixed member, thereby defining an overall stroke for said device, a magnet mounted to one of said members, a magnetically attractable element mounted to the other of said members, and means biasing said members coaxially apart causing said magnet to engage said magnetically attractable element, the improvement comprising:

a. means mounting said magnet to said one member and mounting said magnetically attractable element to said other member, to permit limited axial sliding movement of said magnet with said magnetically attractable element engaged therewith, relative to one of said members, thereby defining initial stroke; and b. means for limiting the length of said initial stroke to less than the length of said overall stroke, whereby axial compressive actuator movement is resisted only by said biasing means the distance of said initial stroke, whereby said movement is resisted by said biasing means plus said magnetic force at the end of said initial stroke, and whereby the magnetically attractable element and magnet are disengaged for the balance of the distance of said overall stroke.

2. The tactile feel device of claim 1 wherein said magnet is mounted to said fixed member and said magnetically attractable element is mounted to said actuator member.

3. The tactile feel device of claim 2 wherein said magnetically attractable element is axially slidably mounted to said actuator member.

4. The tactile feel device of claim 3 wherein said magnetically attractable element is tubular.

5. The tactile feel device of claim 4 wherein said magnetically attractable element is axially slidably mounted to said actuator member by means of a pin mounted to said actuator member transversely to the axis thereof with said tubular magnetically attractable element loosely mounted on said pin.

6. The tactile feel device of claim 5 wherein the difference between the inside diameter of said tubular member and the outside diameter of said pin is less than the distance of the overall stroke of said device.

7. The tactile feel device of claim 6 and a tubular housing member mounted to and extending coaxially from said fixed member.

8. The tactile feel device of claim 7 wherein said actuator member is reciprocally disposed in said tubular housing and emerges from the end thereof opposite said fixed member.

* * * * *